US011958708B2

(12) United States Patent
Guttman et al.

(10) Patent No.: US 11,958,708 B2
(45) Date of Patent: Apr. 16, 2024

(54) TAPE DISPENSER HOLSTER SYSTEM

(71) Applicant: Aimoh, LLC, Monroe, NY (US)

(72) Inventors: Shimon Guttman, Monroe, NY (US); Baruch Herskovits, Monroe, NY (US)

(73) Assignee: Aimoh, LLC, Monroe, NY (US)

( * ) Notice: Subject to any disclaimer, the term of this patent is extended or adjusted under 35 U.S.C. 154(b) by 294 days.

(21) Appl. No.: 17/491,748

(22) Filed: Oct. 1, 2021

(65) Prior Publication Data

US 2022/0106147 A1 Apr. 7, 2022

Related U.S. Application Data

(60) Provisional application No. 63/086,412, filed on Oct. 1, 2020.

(51) Int. Cl.
*B65H 35/00* (2006.01)

(52) U.S. Cl.
CPC .. *B65H 35/0026* (2013.01); *A45F 2200/0575* (2013.01)

(58) Field of Classification Search
CPC ..... A45F 2200/0575; B65H 35/0026
USPC ..... 224/904
See application file for complete search history.

(56) References Cited

U.S. PATENT DOCUMENTS 2,678,184 A * 5/1954 Erdody ..... A47J 47/16 248/302
2,985,349 A * 5/1961 McGuire ..... B44D 3/14 224/907
3,157,927 A * 11/1964 Roden ..... A45F 5/02 D3/226
3,343,735 A * 9/1967 Breeding ..... E04F 21/16 224/678
D221,123 S * 7/1971 Nicholas ..... D3/228
D242,409 S * 11/1976 Enckler ..... D8/373
D248,797 S * 8/1978 Sanders ..... D3/222
(Continued)

FOREIGN PATENT DOCUMENTS

WO WO2019/237021 12/2019
WO WO2020/105932 5/2020

OTHER PUBLICATIONS

"Holstery HammerMaster: A Tactical Hammer Holster," https://www.amazon.com/dp/B07TY5jm3t, Retrieved on Sep. 10, 2020.
(Continued)

*Primary Examiner* — Justin M Larson
(74) *Attorney, Agent, or Firm* — Bochner PLLC; Andrew D. Bochner

(57) ABSTRACT

Apparatus for a sealing material system is provided. The system may include a retaining cage. The system may include a portable sealing dispenser. The portable sealing dispenser may include a handle. The handle may include a wide end and a narrow end. A securing flange may be affixed to the handle. In some embodiments, the retaining cage may be configured to support the securing flange. In some embodiments, the retaining cage may include a first width and a second width. A narrow end of the handle may be configured to pass through the first width. A length of the handle between the narrow end and the wide end may slide through the second width. The wide end of the handle may be supported by the retaining cage.

16 Claims, 15 Drawing Sheets

(56) References Cited

U.S. PATENT DOCUMENTS 4,106,679 A * 8/1978 Hillinger ..... B25H 3/00 224/197
D258,550 S * 3/1981 Strauss ..... 224/678
D261,197 S * 10/1981 Rowswell ..... 224/904
4,372,468 A * 2/1983 Harvey ..... A45F 5/02 224/904
D271,252 S * 11/1983 Sickler ..... D3/228
D288,626 S * 3/1987 Webber ..... D3/221
D291,746 S * 9/1987 Evans ..... D3/229
4,790,461 A * 12/1988 Stover ..... A45F 5/00 224/678
D313,122 S * 12/1990 De Gray ..... 224/904
D324,309 S * 3/1992 Huff ..... D3/228
D330,806 S * 11/1992 Seber ..... D3/228
5,195,667 A * 3/1993 Gallant ..... A45F 5/02 224/904
5,215,236 A * 6/1993 Waddell ..... B65H 35/0026 224/267
5,393,367 A * 2/1995 Yu Chen ..... B65H 35/0033 156/523
D359,848 S * 7/1995 Pounds ..... D3/228
5,477,997 A * 12/1995 Weatherly ..... E04G 21/16 224/678
5,511,705 A * 4/1996 Dreszer ..... A45F 5/021 224/678
5,549,255 A * 8/1996 Huang ..... B65H 35/0033 242/588
D374,604 S * 10/1996 Hnatowicz ..... D8/373
5,605,263 A * 2/1997 Pursley ..... A45F 5/00 224/678
5,641,109 A * 6/1997 Willoughby ..... B65H 35/0026 224/678
D392,826 S * 3/1998 Paikos ..... D6/566
5,792,312 A * 8/1998 Dotterman ..... E06C 7/146 248/302
D406,485 S * 3/1999 Paikos ..... D6/566
5,944,242 A * 8/1999 Musarella ..... B25H 3/006 224/904
5,992,716 A * 11/1999 Riley ..... G01C 9/26 224/904
6,102,264 A * 8/2000 Redzisz ..... A45F 5/02 224/904
6,199,736 B1 * 3/2001 Musarella ..... A45F 5/021 224/904
D445,249 S * 7/2001 Russell ..... D3/228
D452,071 S * 12/2001 Snider ..... D3/228
6,499,637 B1 * 12/2002 Zamarron ..... A45F 5/021 224/904
6,679,404 B2 * 1/2004 Brandt ..... A45F 5/00 224/672
6,880,794 B1 * 4/2005 Kahn ..... E06C 7/143 248/315
D510,258 S * 10/2005 Glass ..... D8/373
D520,061 S * 5/2006 Daunter ..... B65H 35/0033 D19/69
7,077,303 B2 * 7/2006 Zega ..... B25H 3/006 224/904
7,195,140 B1 * 3/2007 Marinelli ..... A45F 5/00 224/672
D564,222 S * 3/2008 Slavov ..... D3/228
D564,592 S * 3/2008 Kwok ..... D19/69
D581,657 S * 12/2008 Rice ..... D3/228
7,591,037 B1 * 9/2009 Strickland ..... B26B 11/00 7/156
D643,704 S * 8/2011 Koehn ..... D8/367
D650,577 S * 12/2011 Glander ..... D3/228
8,499,986 B2 8/2013 Knight et al.
D714,542 S * 10/2014 Barragan ..... D3/228
9,033,197 B2 * 5/2015 Bar ..... A45F 5/06 224/667
D774,753 S * 12/2016 Moreau ..... D8/373
9,808,074 B2 * 11/2017 Kinskey ..... A45F 5/021
D809,787 S * 2/2018 Votel ..... D3/228
10,182,641 B1 1/2019 Goodman
10,306,974 B2 6/2019 Davis
10,414,610 B2 * 9/2019 Fogle ..... A45F 5/022
10,470,556 B1 11/2019 Choi
10,905,225 B2 2/2021 Flores
D925,319 S * 7/2021 Wu ..... D8/71
11,247,865 B1 * 2/2022 Ellis ..... B65H 37/007
D989,475 S * 6/2023 Chambers ..... D3/228
11,744,352 B1 * 9/2023 Chambers ..... A45F 5/021 224/667
2005/0011919 A1 * 1/2005 Durham ..... A45F 5/021 224/248
2007/0045372 A1 * 3/2007 Cangemi ..... A45F 5/02 224/904
2007/0125819 A1 * 6/2007 Kahn ..... B25H 3/006 224/904
2019/0374013 A1 12/2019 Flores et al.
2019/0374014 A1 12/2019 Flores
2022/0106147 A1 * 4/2022 Guttman ..... B65H 35/0026

OTHER PUBLICATIONS

Dewalt DG5139 Heavy-Duty Hammer Holder, https://www.amazon.com/dp/b001p30bxc, Retrieved on Sep. 10, 2020.
"Quick Draw Belt Clip," https:/www.amazon.com/dp/b07thljd4h, Retrieved on Sep. 10, 2020.
"Spider Tool Holster Set," https://www.amazon.com/dp/b07kp54wj9, Retrieved on Sep. 10, 2020.
"CLC Custom Leathercraft 439 Heavy Duty Steel Loop Hammer Holder," https://www.amazon.com/dp/b000189h6e/, Retrieved on Sep. 10, 2020.
"CLC Custom Leathercraft 839 In Swinging Hammer Holder," https://www.amazon.com/dp/b0006gpzlm, Retrieved on Sep. 10, 2020.

* cited by examiner

TAPE DISPENSER HOLSTER SYSTEM

CROSS REFERENCE TO RELATED APPLICATION

This application is a nonprovisional of U.S. Patent Application No. 63/086,412 filed on Oct. 1, 2020, which is hereby incorporated by reference herein in its entirety.

FIELD OF TECHNOLOGY

This disclosure relates to a system for on demand access to sealing material applied to shipping containers.

BACKGROUND

Recent proliferation and growth of online marketplaces has increased demand for efficient packaging systems. Large online marketplaces may ship 1,600,000 packages a day. Packers, who package ordered goods for shipment, may prepare four packages per minute or 200-300 orders per hour. Packers may work 12-hour shifts, preparing 2,400-3,600 packages per day.

To prepare a package, a packer may locate ordered goods. The packer may select an appropriate shipping container for the goods. The container may be a soft mailer envelope, a box or any suitable container for shipping or transporting the goods. The container may be provided in a collapsed state so that the containers themselves may be shipped and stacked efficiently.

The packer may partially assemble the container before inserting the ordered goods into the container. For example, if the container is a box, the packer may first arrange flaps on a bottom portion of the box. The packer may apply tape or other sealing material to the bottom flaps to form a floor of the box. Then the packer may begin inserting goods into the box.

After the ordered goods have all been inserted into the container, the packer may seal the container. For example, the packer may seal the top flaps of a box by applying tape or other sealing material to the top flaps. A container should be sealed such that the container will not open during shipping. The shipping process may expose the container to sorting impact, over-the-road vibration, rotation, temperature fluctuation and other stresses. The sealing process must ensure the container remains closed throughout the shipping process.

After a container is sealed, the packer begins preparing a new order. A packer may need to apply tape or other sealing material to a container at different steps during the packaging process. Conventionally, the packer may pick up and put down sealing material multiple times during the packaging process. However, each time the sealing material is put down, the packer needs to remember where it has been placed so that the packer will be able to quickly retrieve the sealing material at a later time for another step in the packaging process.

The placement of the sealing material requires the packer to remember additional information that may distract the packer. A distracted packer has a higher risk of inserting the wrong items into a container or making other packaging errors such as incorrectly applying sealing material to a container. Requiring the packer to put down and pick up the sealing material also slows down the packaging process.

Putting down and picking up the sealing material also introduces other inefficiencies into the packaging process. For example, ideally the packer needs to have a clear working area to prepare a container and insert goods into the container. Each order may include different goods that need to be packaged in different size containers. However, the same type of sealing material may be applied to the different size containers. The sealing material should preferably be positioned so that it does not obstruct the packer's working area or ability to prepare a package.

However, placing the packaging material outside the packer's working area decreases efficiency of the packaging process. The packer will need to move or turn away from the packaging area to retrieve the sealing material. The packer may not recall where exactly the sealing material was placed and may spend time searching for the sealing material.

Packer work areas may include a sealing material dispenser mounted on a wall or other immobile structure. However, the sealing material dispenser may obstruct the working area. Even if the sealing material dispenser does not obstruct the working area, the packer may need to turn away from the working area to access the sealing material dispenser. It may be complex to refill the sealing material dispenser. Also, if the packer needs to move to a different location, a sealing material dispenser may not be available at the new location.

It would be desirable to provide apparatus and methods that allow for ready access to sealing material without the drawbacks of conventional devices. Therefore, it would be desirable to provide a TAPE DISPENSER HOLSTER SYSTEM.

BRIEF DESCRIPTION OF THE DRAWINGS

The objects and advantages of this disclosure will be apparent upon consideration of the following disclosure, taken in conjunction with the accompanying drawings, in which like reference characters refer to like parts throughout, and in which.

DETAILED DESCRIPTION

Figure 1:
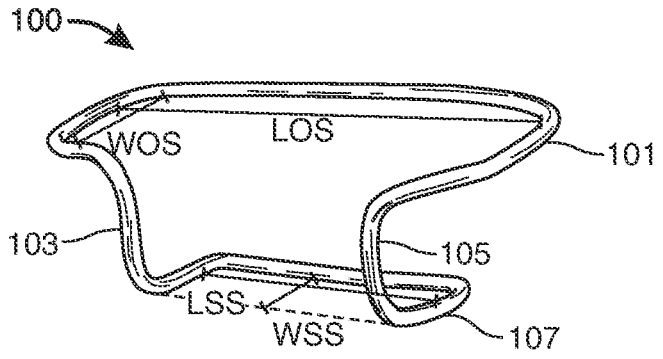
FIG. 1 shows illustrative apparatus in accordance with principles of the disclosure.

Apparatus for a sealing material system is provided. The system may include a retaining cage. The system may include a portable sealing dispenser. The portable sealing dispenser may include a handle. The portable sealing dispenser may include a sealing dispensing mechanism. The portable sealing dispenser may include a securing flange. The securing flange may be affixed to the handle. An illustrative portable sealing dispenser may be a tape dispenser, such as a tape gun.

The retaining cage may include an opening segment. The opening segment may be configured to receive the securing flange. The retaining cage may include a securing segment. The securing segment may be configured to hold the securing flange.

The opening segment may define an insertion surface area. The securing flange may define a flange surface area. The insertion surface area may be larger than the flange surface area. The securing segment may define a securing surface area. The securing surface area may be smaller than the flange surface area.

The insertion surface area may be large enough for the securing flange to pass through the insertion surface area. The securing surface area may be smaller than the flange surface area and may therefore support the securing flange. The securing segment may support the securing flange against a gravitational force acting on the portable sealing dispenser.

The securing segment may define a support platform. The support platform may support the securing flange against a gravitational force. The securing segment may include at least one retention member. The at least one retention member may extend from the support platform. The at least one retention member may extend perpendicular to the support platform. When the securing flange is supported by the support platform, the at least one retention member may prevent the securing flange from sliding off the support platform.

The securing segment may encircle at least three sides of the handle of the portable sealing dispenser. The securing segment may encircle the handle except for an opening that is large enough for the handle to be inserted into the securing surface area. For example, when the handle is circular, the opening may be larger than a diameter of the handle. When the handle is square or rectangular shaped, the opening may be larger than one side of the handle.

The at least one retention member may extend from the support platform to the opening segment. The at least one retention member may extend perpendicular to the support platform. The at least one retention member may extend perpendicular to the opening segment. The at least one retention member may be configured to guide the securing flange from the opening segment onto the support platform defined by the securing segment. The opening segment of the retaining cage may be spaced apart from the support segment by a length of the at least one retention member. After the securing flange is positioned on the support platform, the at least one retention member may prevent the securing flange from sliding off the support platform.

A single contiguous member may be bent to form component segments of the retaining cage. For example, the opening segment and the securing segment may be formed from a single contiguous member. The opening segment, the support platform and the at least one retention member may all be formed from a single contiguous member. A single contiguous member used to form the retaining cage may be cylindrically shaped. For example, the retaining cage may be constructed from metal wire, metal tubing or any other suitable material.

The opening segment may define the insertion surface area. The securing flange may define the flange surface area. The insertion surface area may be proportional to the flange surface area. The securing segment may define the securing surface area. The securing surface area may be proportional to the flange surface area.

The system may include a holster. The holster may support the retaining cage. The holster may be constructed from any suitable material. For example, the holster may be constructed from leather, fiberglass, metal, fabric, plastic or any suitable combination of materials. Illustrative materials may include thermoplastic acrylic-polyvinyl chloride such as Kydex® manufactured by Sekisui SPI of Bloomsburg, PA.

The holster may be configured to be supported by clothing of a packer. For example, the holster may include components for the holster to be mounted to a waistband of the packer's clothing. The holster may include a clip for attachment to the waistband. The holster may include at least one pass-through for sliding the holster onto a belt worn by the packer. The holster may include two or more pass-throughs. A belt worn by the packer may be passed through the one or more pass-throughs to secure the holster to the packer's belt.

Securing segments of the retaining cage may define a support border. In some embodiments, the securing segments in combination with a surface of the holster may form the support border. In some embodiments, a handle of a portable sealing dispenser such as a tape dispenser may be inserted into an area defined by the support border. The support border may support the tape dispenser against a gravitational force.

For example, the support border may support the tape dispensing mechanism against a gravitational force when the holster is suspended above a surface (e.g., when attached to a waistband of a packer). The support border may be configured to support a handle of a sealing dispensing mechanism. The support border may be configured to support other components of a sealing dispensing mechanism.

The support border may support a sealing dispensing mechanism, or a roll of tape mounted on the tape dispensing mechanism. In such embodiments, a handle of the tape dispenser may be positioned at a lower gravitational potential than the roll of tape or tape dispensing mechanism. For example, the support border defined by the retaining ring may be configured such when a tape dispensing mechanism is supported by the retaining ring, gravity pulls the handle away from the support border.

The handle of the tape dispenser may be weighted to increase gravitational pull on the handle. A weighted handle may prevent the tape dispensing mechanism supported above the support border from falling out or off the support border. An illustrative weight of a conventional tape dispenser may be about 13 ounces. Tape dispensers disclosed herein that include a weighted handle may have weights of 15-25 ounces or more.

In some embodiments, the handle may be long enough to provide a counterbalance that prevents weight of the tape dispensing mechanism from pulling the handle out of the support border. In such embodiments, the handle may be longer than a typical length of a conventional tape dispenser. For example, conventional tape dispensers may have handles that are between 5-7-inches in length. The handles of tape dispensers disclosed herein may have lengths of 7-15 inches or longer.

A securing segment of the retaining cage may be moveable. The retaining cage may include two or more moveable securing segments. A moveable securing segment may rotate or pivot to allow the handle of a portable sealing dispenser such as a tape gun to be admitted into the retaining cage. For example, to insert the portable sealing dispenser into the retaining cage, the packer may press the handle of the portable sealing dispenser against a moveable securing segment. In response to the applied pressure, the moveable securing segment may rotate and admit the handle into the retaining cage. The applied pressure may cause the moveable securing segment to rotate toward the holster.

After the handle is positioned within the retaining cage, the moveable securing segment may return to a default position. For example, the moveable securing segment may be spring-loaded to remain in a default position absent applied pressure. In the default position, securing segments including, one or more moveable securing segments, may define a support border of the retaining cage. In such embodiments, the support border may define an enclosed support perimeter.

Positioning the handle within the enclosed support perimeter may prevent the handle from falling out of the retaining cage. After the handle is positioned within the enclosed support perimeter, the packer may release the handle. The enclosed support perimeter of the retaining cage may catch the securing flange, tape dispensing mechanism or any other component of the portable sealing dispenser and thereby support the portable sealing dispenser.

The retaining cage may include a release mechanism for removing the portable sealing dispenser from the enclosed support perimeter. The release mechanism may allow the moveable securing segment to swing away from the holster and the handle of the portable sealing dispenser to be removed from the retaining cage.

In some embodiments, the holster may include a channel. The channel may have a retaining end and an open end. The channel may be configured to receive a protrusion affixed to a portable sealing dispenser. The protrusion may be releasably affixed to the portable sealing dispenser. For example, the protrusion may be mounted on a handle of the tape dispenser. The protrusion may be permanently fixed to the handle. For example, the protrusion may be integrally molded with the handle.

To mount the portable sealing dispenser on the holster, the packer may slide the protrusion into the open end of the channel. The holster may include a locking mechanism may prevent the protrusion from sliding out of the open end of the channel. The locking mechanism may keep the protrusion seated against the retaining end of the channel. The locking mechanism may engage the protrusion. The locking mechanism may close the channel and prevent the protrusion from sliding out the open end of the channel.

The locking mechanism may be a spring-loaded pawl. The locking mechanism may be mounted on the holster. The locking mechanism may be a spring-loaded pawl that allows the protrusion to slide past the pawl as the protrusion is sliding in the channel from the open end toward the retaining end. After the protrusion slides past the pawl, the pawl may prevent the protrusion from sliding out of the channel.

The locking mechanism may be toggled on or off by the packer. When the locking mechanism is toggled "off," the locking mechanism may not prevent the protrusion from sliding out of the open end of the channel. Even when the locking mechanism is toggled "off," a gravitational force may keep the protrusion seating against the retaining end of the channel. For example, the locking mechanism may be toggled "off" when the packer is actively packaging containers. This will allow the tape dispenser to be quickly inserted and removed from the holster without being restricted by the locking mechanism.

In some embodiments, the holster, when affixed to the packer, may position the retaining cage such that when the securing flange is positioned on the supporting platform. Gravity may pull a sealing dispensing mechanism of the portable sealing dispenser away from the support platform. The at least one retention member may prevent the securing flange from sliding off the support platform. A surface of the holster may prevent the securing flange from sliding off the support platform. The supporting platform may hold the support flange of the sealing dispenser. The one or more retention members my prevent the securing flange from sliding off the support platform in a first direction. A front surface of the holster may prevent the securing flange from sliding off the support platform in a second direction.

The holster may include a front surface and a back surface. The retaining cage may be affixed to the front surface of the holster. A belt or waistband mount may be affixed to the back surface. In some embodiments, the belt mount may include a clip mounted on the back surface. The clip may attach the holster to the packer's belt or waistband. In some embodiments, the belt mount may include one or more pass-throughs that extend through the front and back surfaces. A belt of the packer may be inserted into the pass-throughs.

The sealing dispensing mechanism may be affixed to a first end of the handle. The securing flange may be affixed to a second end of the handle. The sealing dispensing mechanism may be configured to hold at least one roll of packaging tape or other sealing material. The sealing dispensing mechanism may be configured to dispense any suitable sealing material such as glue or string. When the securing flange is supported by the retaining cage and the holster is attached to the packer, the sealing dispenser mechanism may be positioned at a lower gravitational potential energy than the securing flange.

Methods for packaging goods in a container are provided. Methods may include applying sealing material dispensed by a portable sealing dispenser to seal a first container. Methods may include after sealing the first container, positioning the portable sealing dispenser in a retaining cage mounted on a packer's waistband.

Methods may include obtaining a second container. Methods may include inserting goods into the second container. Methods may include removing the portable sealing dispenser from the retaining cage. Methods may include applying sealing material dispensed by the portable sealing dispenser to seal the second container. Methods may include re-positioning the portable sealing dispenser in the retaining cage after sealing the second container.

Apparatus and methods in accordance with this disclosure will now be described in connection with the figures, which form a part hereof. The figures show illustrative features of apparatus and method steps in accordance with the principles of this disclosure. It is to be understood that other embodiments may be utilized, and that structural, functional and procedural modifications may be made without departing from the scope and spirit of the present disclosure.

The steps of methods may be performed in an order other than the order shown and/or described herein. Method embodiments may omit steps shown and/or described in connection with illustrative methods. Method embodiments may include steps that are neither shown nor described in connection with illustrative methods. Illustrative method steps may be combined. For example, an illustrative method may include steps shown in connection with any other illustrative method.

Apparatus may omit features shown and/or described in connection with illustrative apparatus. Apparatus embodiments may include features that are neither shown nor described in connection with illustrative apparatus. Features of illustrative apparatus may be combined. For example, an illustrative apparatus embodiment may include features shown or described in connection with any other illustrative apparatus and/or method embodiment.

FIG. 1 shows illustrative retaining cage 100. Retaining cage 100 includes opening segment 101. Opening segment 101 defines width WOS and length LOS. WOS and LOS may define an insertion surface area.

Retaining cage 100 includes securing segment 107. Securing segment 107 defines width WSS and length LSS. WSS and LSS may define a securing surface area. Retaining cage 100 includes retention members 103 and 105. Retention members 103 and 105 extend from securing segment 107 to opening segment 101.

Figure 2:
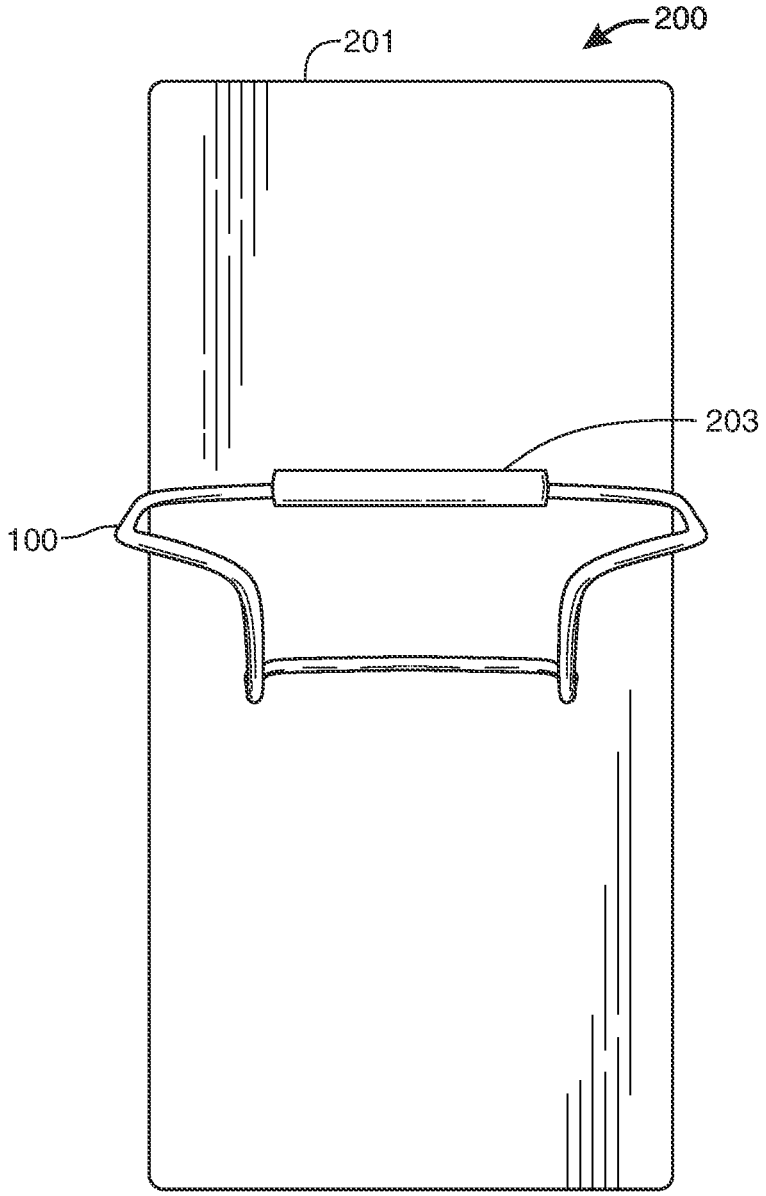
FIG. 2 shows illustrative apparatus in accordance with principles of the disclosure.

FIG. 2 shows illustrative apparatus 200. Apparatus 200 includes holster 201. Retaining cage 100 is affixed to holster 201 via loop attachment 203.

Figure 3:
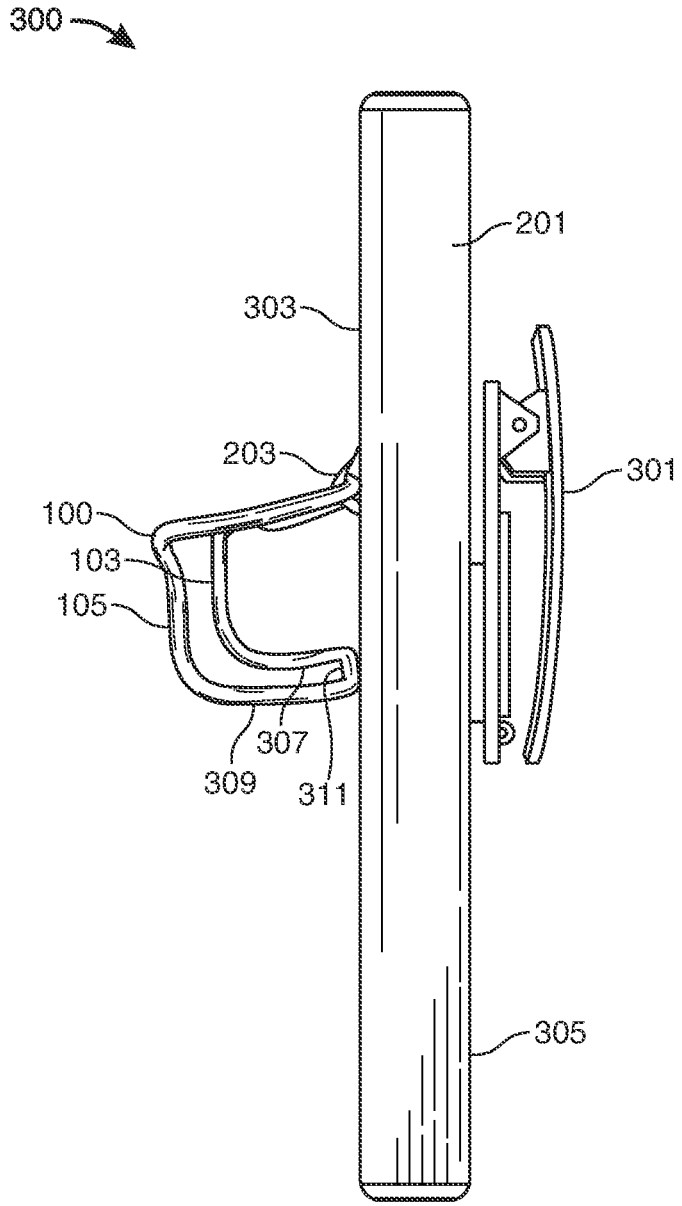
FIG. 3 shows illustrative apparatus in accordance with principles of the disclosure.

FIG. 3 shows view 300 of apparatus 200. View 300 shows that loop attachment 203 is positioned on front surface 303 of holster 201. View 300 shows that holster 202 includes belt clip 301. Belt clip 301 is affixed to back surface 305 of holster 201. Belt clip 301 may be used to attach holster 201 to a waistband or belt.

View 300 shows that securing segment 107 (shown in in FIG. 1) includes segments 307, 309 and 311. Segments 307, 309 and 311 collectively define a supporting platform. In some embodiments, segment 311 may be affixed to holster 201. For example, segment 311 may be affixed to holster 201 using another loop attachment similar to loop attachment 203.

Figure 4:
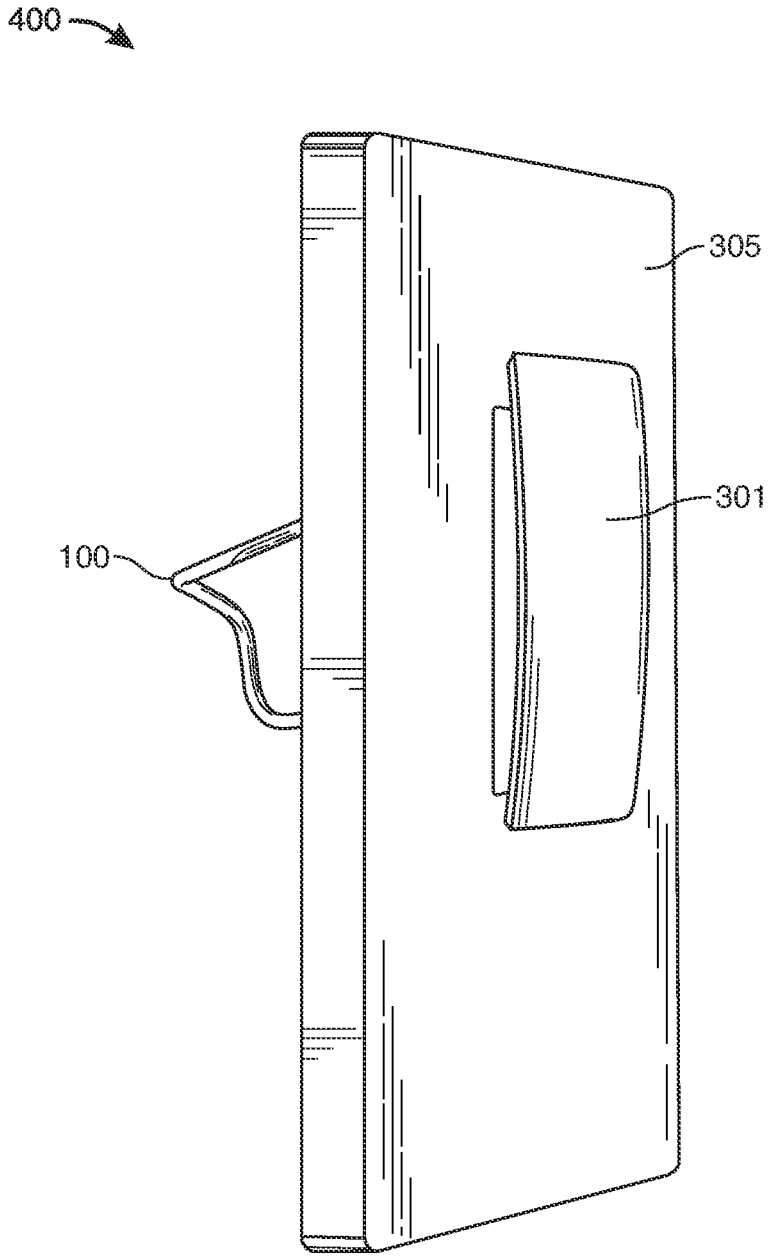
FIG. 4 shows illustrative apparatus in accordance with principles of the disclosure.

FIG. 4 shows illustrative view 400 of apparatus shown in FIG. 3. Illustrative view 400 is a perspective view of apparatus 300.

Figure 5:
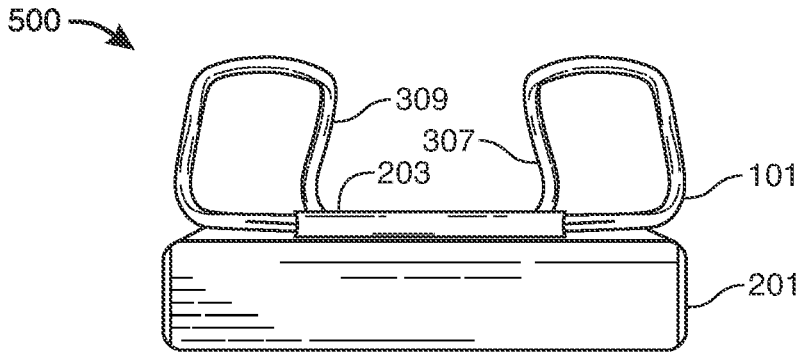
FIG. 5 shows illustrative apparatus in accordance with principles of the disclosure.

FIG. 5 shows illustrative view 500 of apparatus shown in FIGS. 2 and 3. View 500 is a top-down view of apparatus shown in FIGS. 2 and 3. View 500 illustrates an orientation of holster 201 when affixed to a waistband of a packer and viewed by the packer looking down toward a floor on which the packer is standing. Belt clip 301 is not shown in FIG. 5.

Figure 6:
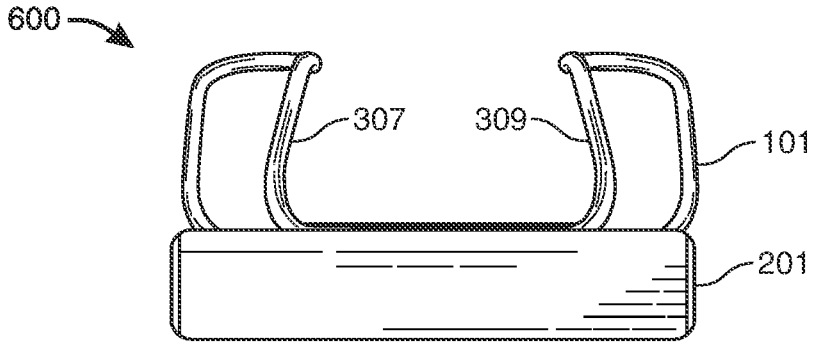
FIG. 6 shows illustrative apparatus in accordance with principles of the disclosure.

FIG. 6 shows illustrative view 600 of apparatus shown in FIGS. 2 and 3. View 600 is a bottom-up view of apparatus shown in FIGS. 2 and 3. View 600 shows an orientation of holster 201 when affixed to a waistband of a packer and viewed from a floor on which the packer is standing looking toward a head of the packer. Belt clip 301 is not shown in FIG. 6.

Figure 7:
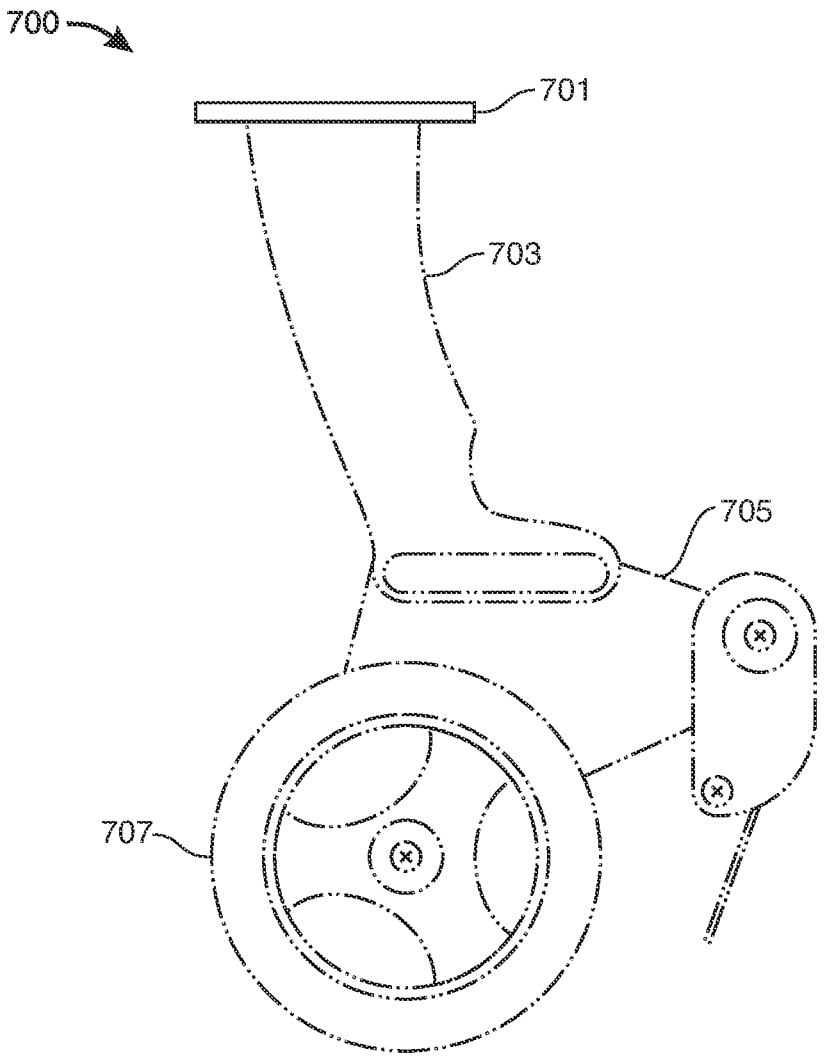
FIG. 7 shows illustrative apparatus in accordance with principles of the disclosure.

FIG. 7 shows illustrative portable sealing dispenser 700. Dispenser 700 includes handle 703. Dispenser 700 includes sealing dispensing mechanism 705. Sealing dispensing mechanism 705 may dispense packaging tape 707. Dispenser 700 includes securing flange 701. Securing flange 701 is affixed to handle 703.

Figure 8:
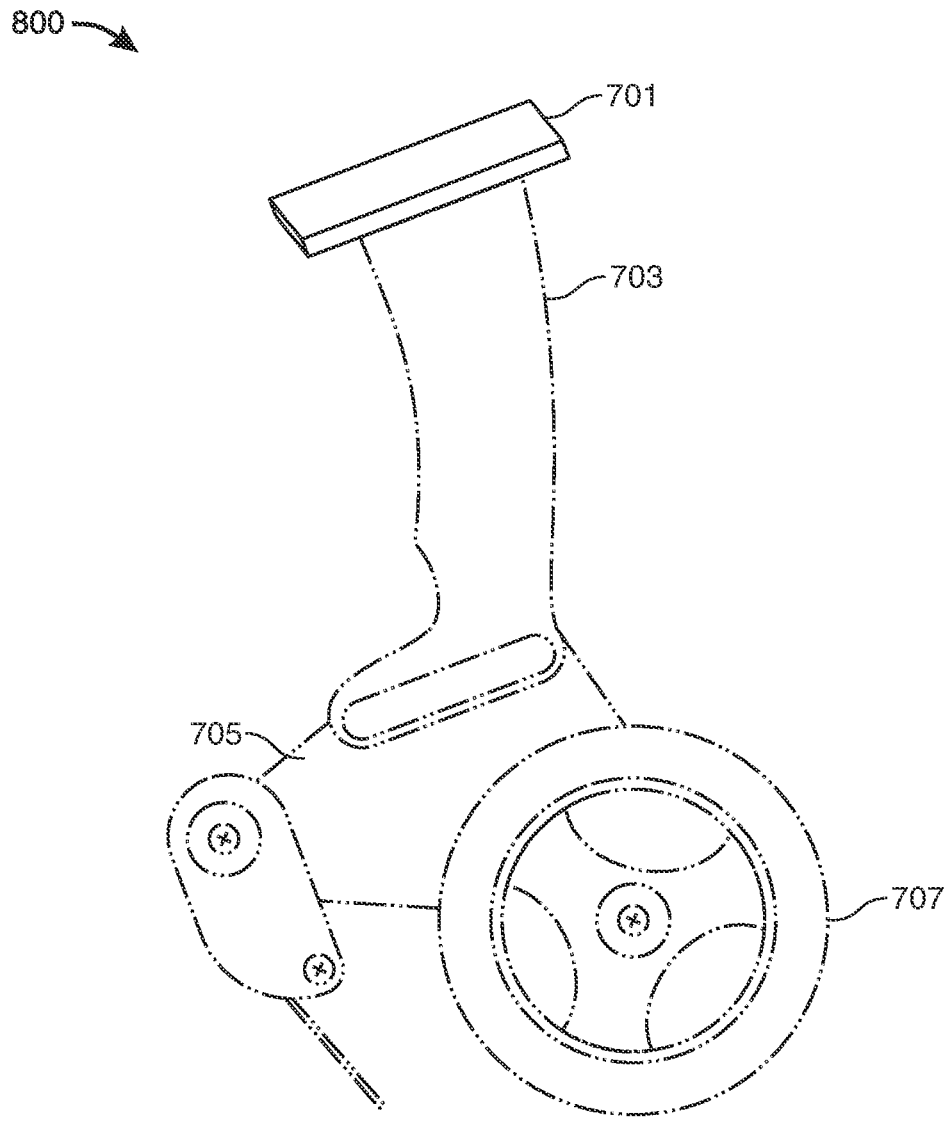
FIG. 8 shows illustrative apparatus in accordance with principles of the disclosure.

FIG. 8 shows another illustrative perspective view 800 of securing flange 701. Perspective view 800 shows an illustrative surface area of securing flange 701.

Figure 9:
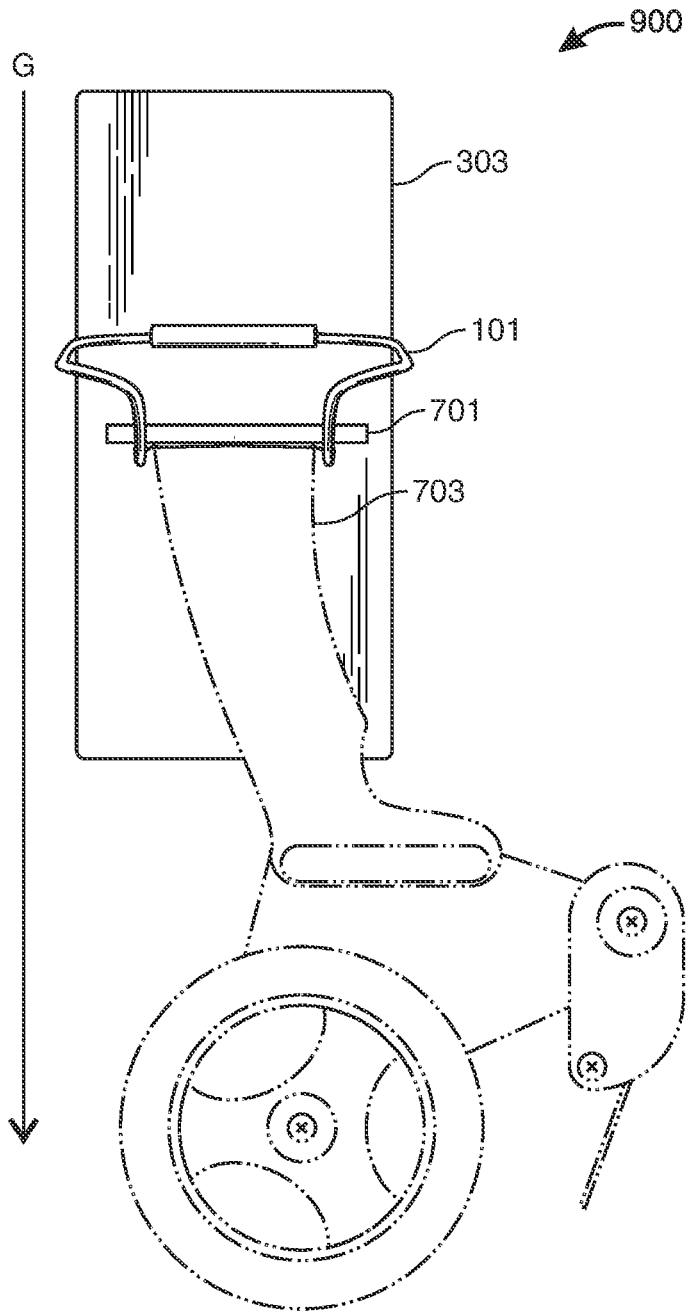
FIG. 9 shows illustrative apparatus in accordance with principles of the disclosure.

FIG. 9 shows illustrative view 900 of holster 201 (shown in FIGS. 2 and 3) and portable sealing dispenser 700 (shown in FIG. 7). View 900 shows that securing flange 701 has been inserted into insertion surface area of opening segment 101 (shown in FIG. 1). As shown in FIG. 1, insertion surface area may be defined by $W_{OS}$ and $L_{OS}$. The insertion surface area may be larger than a flange surface area defined by securing flange 701 (shown in FIG. 8), allowing securing flange 701 to be inserted into opening segment 101.

View 900 shows securing flange 701 resting on a support border defined by securing segment 107 (shown in FIG. 1). Segments 307, 309 and 311 (shown in FIG. 3) define the support border of securing segment 107. Segments 307, 309 and 311 may retain handle 703 within the support border defined by securing segment 107.

Retention members 103 and 105 (shown in FIG. 1) may guide securing flange 701 onto a support platform of securing segment 107. Retention members 103 and 105 may prevent securing flange 701 from sliding off the support platform in a first direction (e.g., out of the page). A front surface 303 of holster 303 may prevent the securing flange from sliding off the support platform in a second direction (e.g., into the page).

Holster 201 may be supported by clothing worn by a packer. For example, belt clip 301 (shown in FIG. 3) may be used to affix holster 201 to a waistband of the packer. When holster 201 is supported by clothing of the packer, and securing flange 701 is positioned on the supporting platform defined by securing segment 107, gravity pulls the sealing dispensing mechanism away from retaining cage 100 in direction G. When securing flange 701 is positioned within retaining cage 100, sealing dispenser mechanism 705 is positioned at a lower gravitational potential energy than the securing flange 701.

Figure 10A:
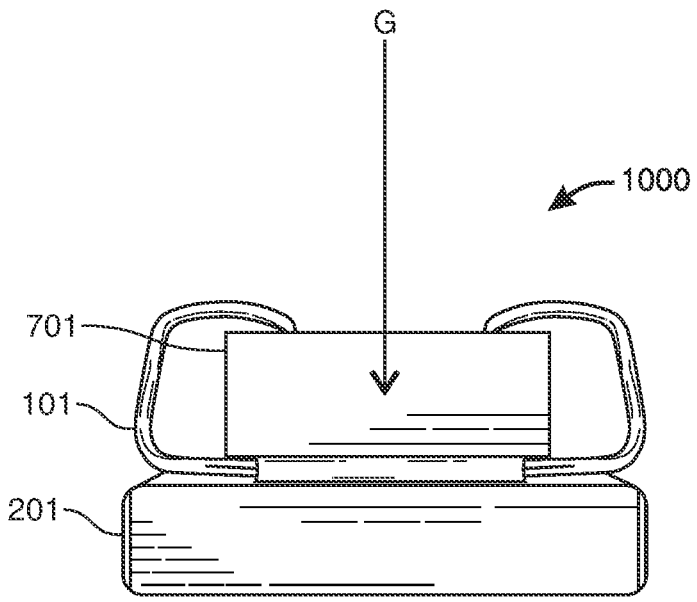
FIG. 10A shows illustrative apparatus in accordance with principles of the disclosure.

FIG. 10A shows illustrative top-down view 1000 of securing flange 701 positioned in retaining cage 101. View 1000 shows that a gravitational force is acting on securing flange in direction G.

Figure 10B:
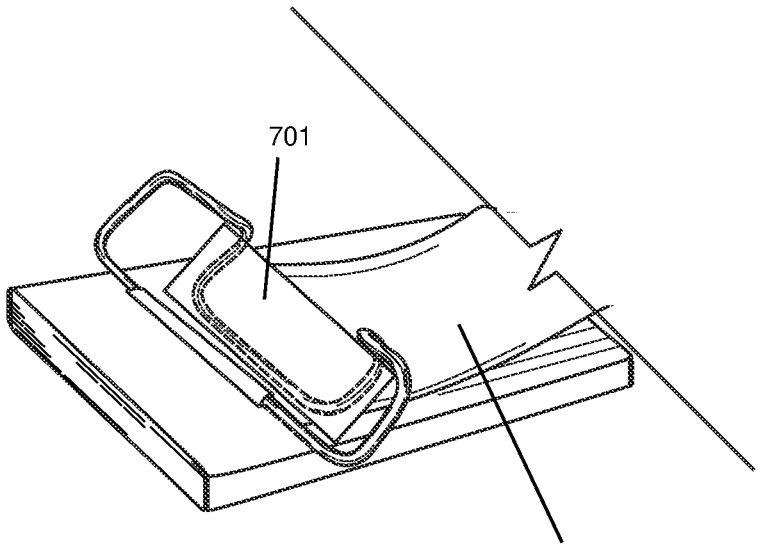
FIG. 10B shows illustrative apparatus in accordance with principles of the disclosure.

FIG. 10B shows illustrative perspective view of securing flange 701 positioned in retaining cage 101 and positioned on a support platform defined by securing segment 107. FIG. 10B shows segments 307, 309 and 311 (in broken line) retaining handle 703 within securing segment 107. FIG. 10B shows retention members 103 and 105 preventing securing flange 701 from sliding off the support platform. FIG. 10B shows front surface 201 of holster 201 preventing securing flange 701 from sliding off the support platform.

Figure 11:
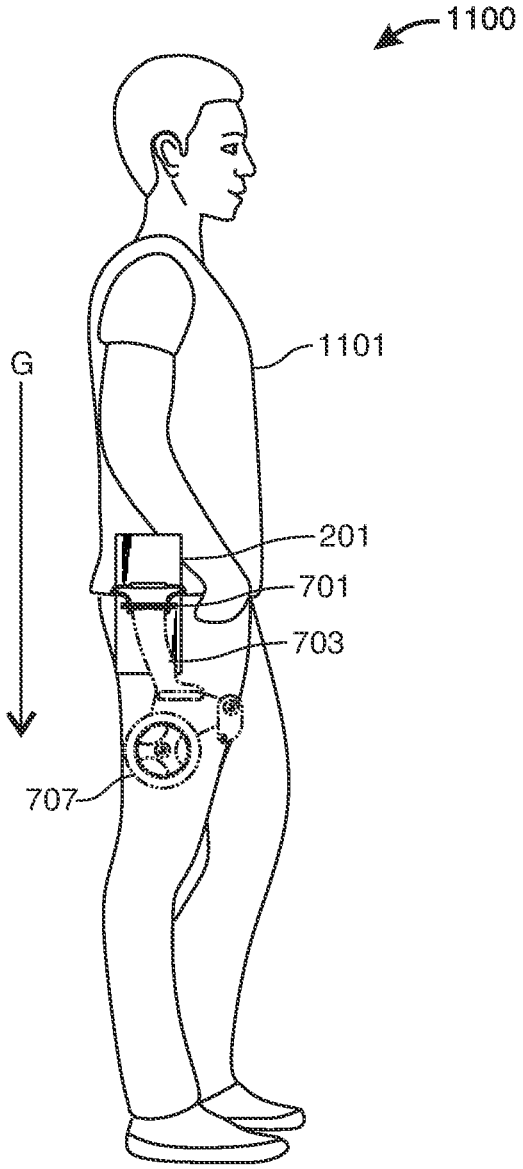
FIG. 11 shows illustrative apparatus in accordance with principles of the disclosure.

FIG. 11 shows illustrative scenario 1100. Scenario 1100 shows holster 201 affixed to a waistband of packer 1101. Scenario 1100 shows portable sealing dispenser 700 positioned in retaining cage 100. Securing flange 701 is supported by securing segment 107 of retaining cage 100. Opening segment 101 allows securing flange 701 and portable sealing dispenser 700 to be easily removed from retaining cage 100. After being removed from retaining cage 100, packer 1100 may apply sealing material 707 to a container.

After applying sealing material 707 to the container, portable sealing dispenser 700 may be reinserted into retaining cage 100. Thus, portable sealing dispenser 700 may remain easily accessible to and usable by packer 1101. Keeping sealing dispenser 700 easily accessible to packer 1101 may increase efficiency of a packaging process. FIG. 11 also shows direction G of a gravitational force that acts on portable sealing dispenser 700 when supported by securing segment 107 of retaining cage 100.

Figure 12:
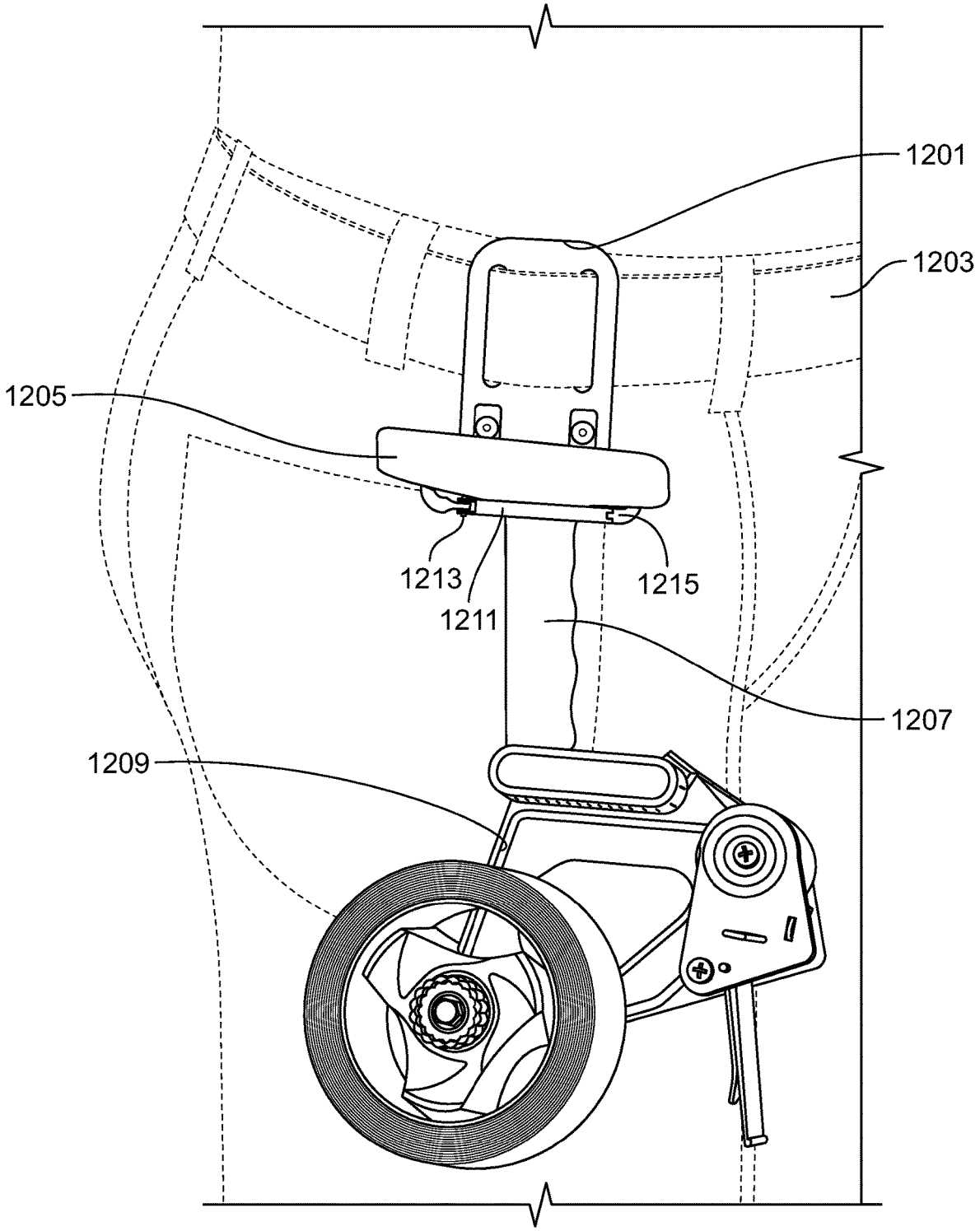
FIG. 12 shows illustrative apparatus in accordance with principles of the disclosure.

FIG. 12 shows illustrative holster 1201 mounted on belt 1203 of a packer. Holster 1201 includes two pass-throughs for sliding holster 1201 onto belt 1203. Retaining cage 1215 is affixed to holster 1201. Retaining cage 1215 includes moveable securing segment 1211. Moveable securing segment 1211 may rotate or pivot to the allow handle 1207 to be admitted into retaining cage 1215. Pin 1213 may be inserted through moveable securing segment 1211 to allow for rotation.

In some embodiments, a packer may press handle 1207 against moveable securing segment 1211. In response to the applied pressure, moveable securing segment 1211 may rotate about pin 1213 and admit handle 1207 into an enclosed support perimeter defined by retaining cage 1215. In such embodiments, moveable securing segment 1211 may rotate toward the holster 1201.

After handle 1207 is within the enclosed support perimeter defined by retaining cage 1215, moveable securing segment 1211 may return to a default position. FIG. 12 shows moveable securing segment 1211 in the default position. Moveable securing segment 1211 may be spring-loaded to remain in the default position absent applied pressure. In the default position, moveable securing segment 1211 prevents handle 1207 from falling out of retaining cage 1215. After handle 1207 is positioned within the enclosed support perimeter defined by retaining cage 1215, the packer may release handle 1207. Retaining cage 1215 may catch securing flange 1205 and support tape dispenser 1209.

In some embodiments, moveable securing segment 1211 may rotate away from holster 1201 to admit handle 1207 into an enclosed support perimeter defined by retaining cage 1215. A packer may insert handle 1207 into an opening in retaining cage 1215 created when moveable securing segment 1211 rotates away from holster 1201. Moveable securing segment 1211 may be spring-loaded to remain in a default position shown in FIG. 12 and prevent handle 1207 from falling out of retaining cage 1215. When the packer wishes to remove tape dispenser 1209 from retaining cage 1215, packer may apply force needed to overcome the biasing of the spring, rotate moveable securing segment 1211 away from holster 1201 and create an opening in retaining cage 1215 and the associated enclosed support perimeter to remove handle 1207.

Handle 1207 is narrower than handle 703 (shown in FIG. 7) or handle 1307 (shown below in FIG. 13). Handle 1207 may be narrower so that it may be inserted into the opening created in retaining cage 1215 when moveable securing segment 1211 rotates towards or away from holster 1201.

Figure 13:
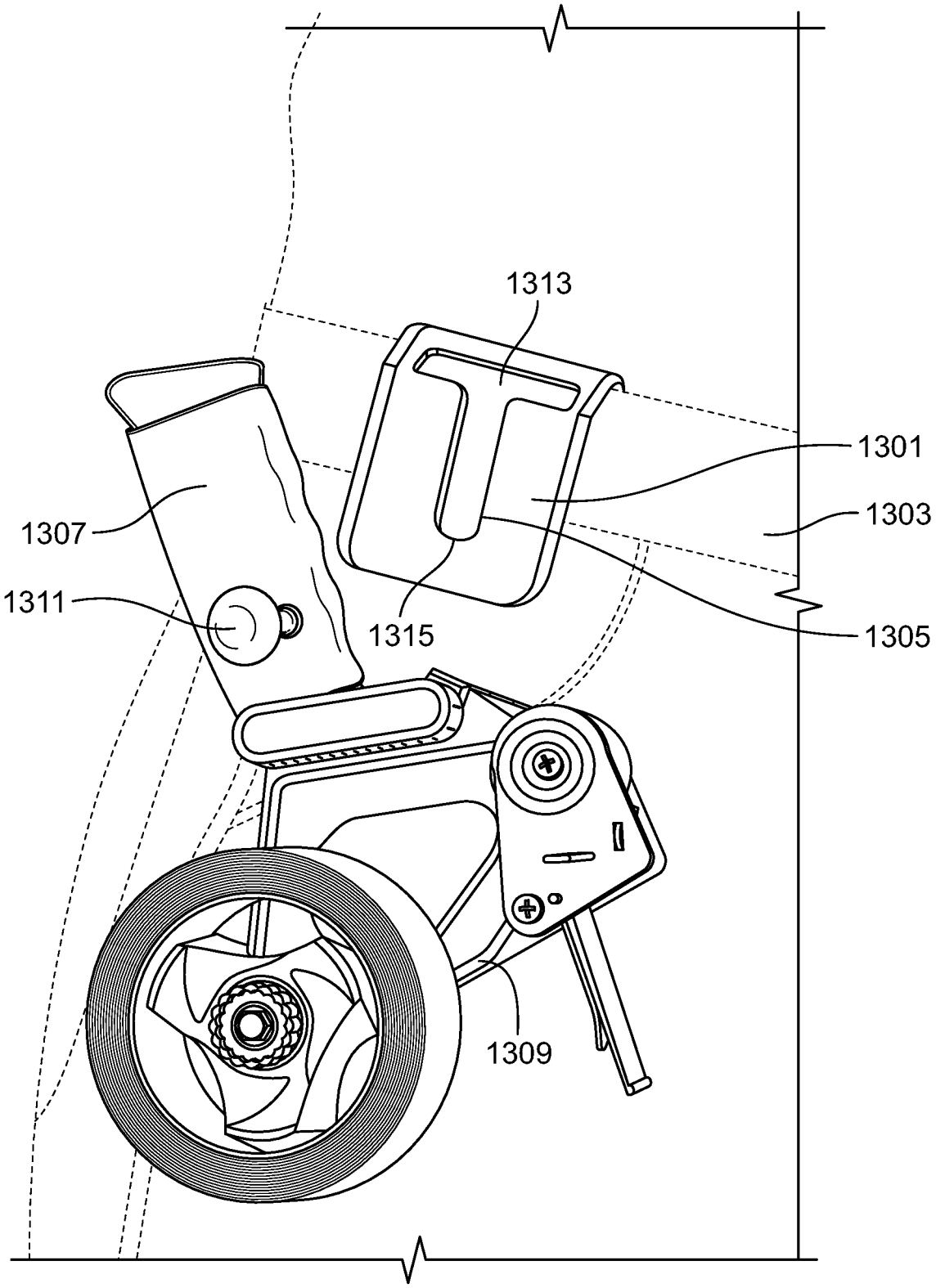
FIG. 13 shows illustrative apparatus in accordance with principles of the disclosure.

FIG. 13 shows holster 1301 mounted on belt 1303 of a packer. Holster 1301 includes channel 1305. Channel 1305 includes retaining end 1315. Channel 1305 includes open end 1313. Open end 1313 of channel 1305 is configured to receive protrusion 1311 affixed to handle 1307 of tape dispenser 1309. In some embodiments, protrusion 1311 may be releasably affixed to handle 1307.

To mount tape dispenser 1309 in holster 1301, a packer may slide protrusion 1311 into open end 1313 of channel 1305. Holster 1301 may include a locking mechanism (not shown) that prevents protrusion 1311 from sliding out of channel 1305. The locking mechanism may be a spring-loaded pawl mounted on holster 1301 that engages when protrusion 1311 is fully seated at retaining end 1315 of channel 1305. In some embodiments, the locking mechanism may engage protrusion 1311.

When protrusion 1311 is seated at retaining end 1315 of channel 1305, the packer may release tape dispenser 1309. Holster 1301 may keep tape dispenser 1309 mounted on belt 1303. The packer may slide protrusion 1311 out of channel 1305 when tape dispenser 1309 is needed to seal a container. The packer may slide protrusion 1311 into channel 1305 after sealing the container.

Figure 14:
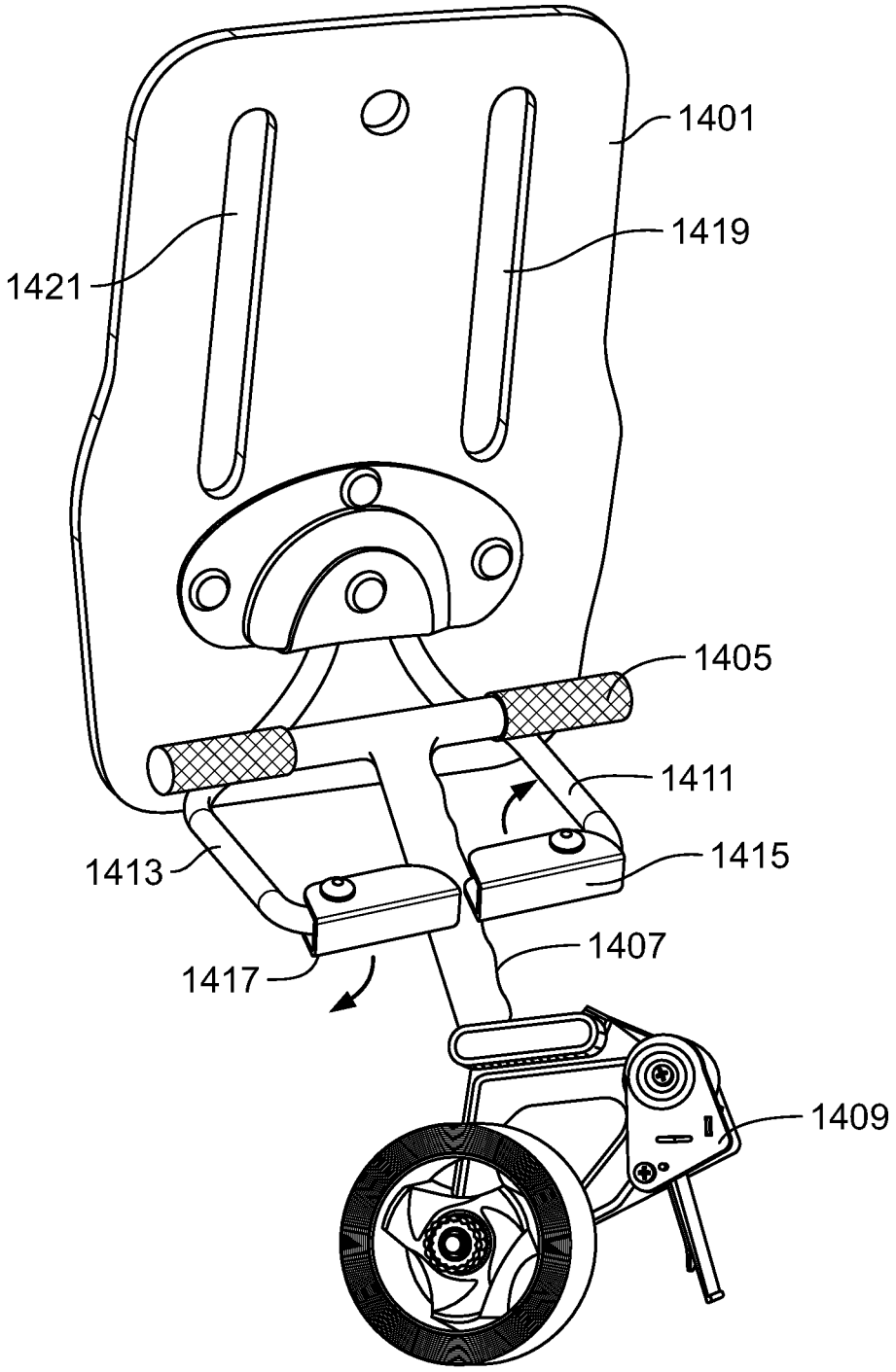
FIG. 14 shows illustrative apparatus in accordance with principles of the disclosure.

FIG. 14 shows holster 1401 that may be mounted on a belt of a packer. Holster 1401 includes pass-through 1421 and pass-through 1419 for sliding holster 1401 onto a belt. A retaining cage is affixed to holster 1401. The retaining cage includes securing segments 1411 and 1413. The retaining cage includes moveable securing segments 1417 and 1415. Moveable securing segments 1417 and 1415 may rotate or pivot to the allow handle 1407 of tape dispenser 1409 to be admitted into the retaining cage.

Holster 1401 and its associated retaining cage may be configured to secure any suitable portable sealing dispenser. For example, holster 1401 and its associated retaining cage may be configured to secure handle 703 and securing flange 701 of tape dispenser 705 (shown in FIG. 7). Securing segments 1411, 1413, 1417 and 1415 define a support border.

A packer may press handle 1407 against moveable securing segments 1417 and 1415. In response to the applied pressure, moveable securing segments 1417 and 1415 may rotate and admit handle 1407 into the retaining cage. Moveable securing segments 1417 and 1415 may rotate toward holster 1401. Moveable securing segments 1417 and 1415 may rotate away from holster 1401.

Moveable securing segments 1417 and 1415 may be spring-loaded to remain in a default position absent applied pressure. FIG. 14 shows moveable securing segments 1417 and 1415 in the default position. In the default position, moveable securing segments 1417 and 1415 may prevent handle 1407 from falling out of the retaining cage. A biasing force of spring-loaded moveable securing segments 1417 and 1415 may prevent handle 1407 from falling out of the retaining cage.

After handle 407 is positioned with the retaining cage, the support border (defined by securing segments 1411, 1413, 1417 and 1415) supports securing flange 1405 against a gravitational force. After handle 1407 is positioned within the retaining cage, the packer may pull handle 1407 out of the retaining cage. When the packer pulls handle 1407 out of the retaining cage, moveable securing segments 1417 and 1415 swing away from holster 1401 and allow handle 1407 to be removed from the retaining cage.

To reinsert tape dispenser 1409 into retaining cage, the packer may push handle 1407 against moveable securing segments 1417 and 1415. When the packer pushes handle 1407 against moveable securing segments 1417 and 1415, moveable securing segments 1417 and 1415 may swing inward toward holster 1401 and allow handle 1407 to inserted into the retaining cage. After handle 1407 is positioned within the retaining cage, a support platform defined by the moveable and non-moveable securing segments may support securing flange 1405, tape dispensing mechanism or any other component of tape dispenser 1409 and support tape dispenser 1409.

Figure 15:
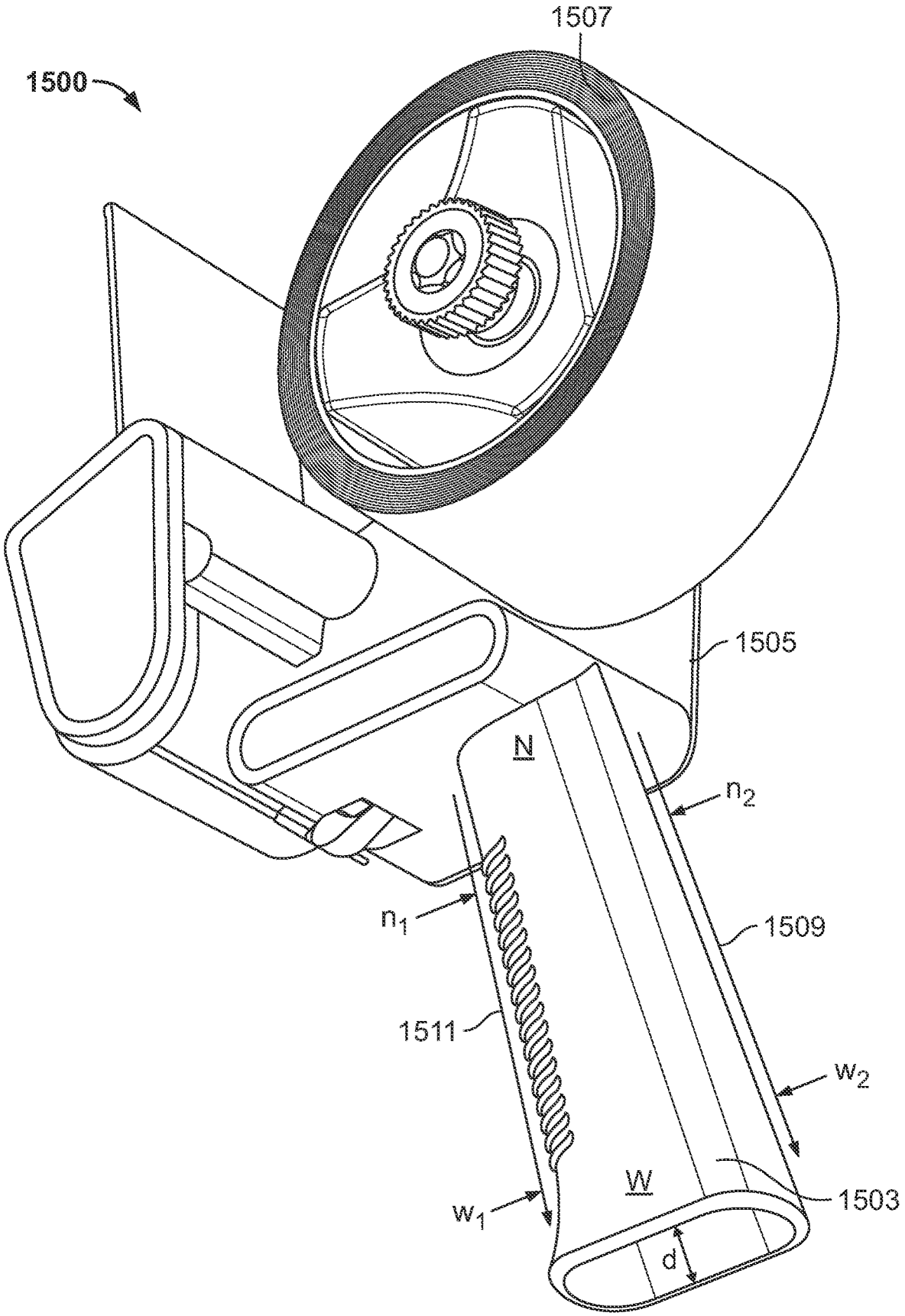
FIG. 15 shows illustrative apparatus in accordance with principles of the disclosure.

FIG. 15 shows illustrative portable sealing dispenser 1500. Portable sealing dispenser 1500 may include one or more features of portable sealing dispenser 700. Portable sealing dispenser 1500 includes sealing dispensing mechanism 1505. Packaging tape 1507 is mounted on sealing dispensing mechanism 1505. Portable sealing dispenser 1500 includes handle 1503. Arrows 1509 and 1511 show that handle 1503 widens from narrow end N (e.g., at or near $n_1/n_2$) toward wide end W (e.g., at or near $w_1/w_2$) The narrow end N of handle 1503 is closer to sealing dispensing mechanism 1505 than wide end W.

As shown in FIG. 15, a width of handle 1503 between $n_1$ and $n_2$ may be less than a width of handle 1503 between $w_1$ and $w_2$. An illustrative width of handle 1503 between $n_1$ and $n_2$ may be ¾ of an inch. An illustrative width of handle 1503 between $w_1$ and $w_2$ may be 1½ inches. Handle 1503 may progressively widen from $n_1/n_2$ to $w_1/w_2$. FIG. 15 also shows that handle 1503 has a depth of d.

Figure 16:
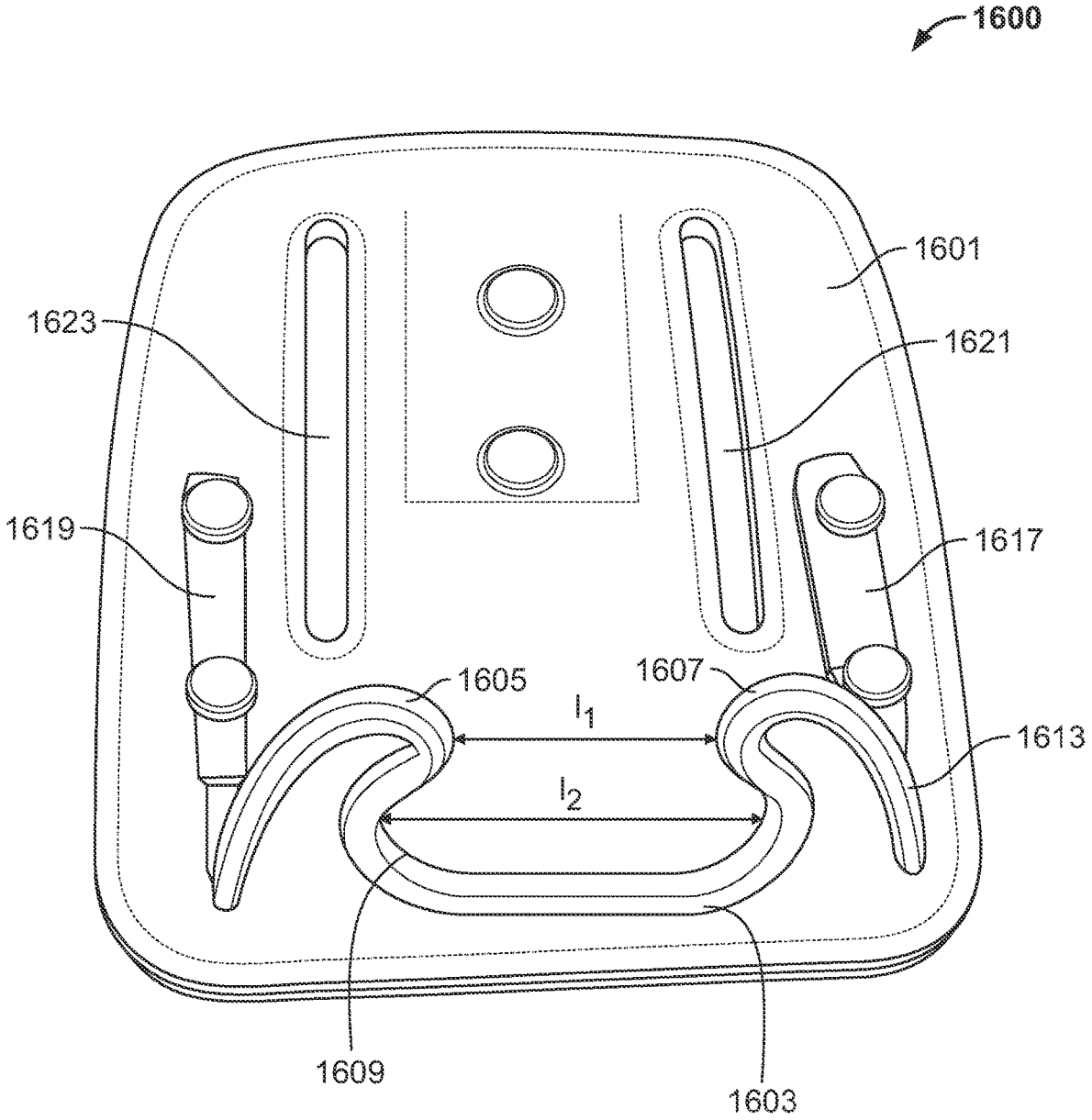
FIG. 16 shows illustrative apparatus in accordance with principles of the disclosure.

FIG. 16 shows illustrative holster 1600. Holster 1600 includes pass-throughs 1623 and 1621. A belt may be inserted into pass-throughs 1623 and 1621 to mount holster 1600 to clothing of a packer. Holster 1600 includes front surface 1601. Holster includes retaining cage 1613. Retaining cage 1613 is illustratively mounted to front surface 1601 by affixation segments 1619 and 1617.

Retaining cage 1613 includes support arms 1605 and 1607. Support arms 1605 and 1607 link retaining cage 1613 to affixation segments 1619 and 1617. Support arms 1605 and 1607 allow retaining cage 1613 to extend away from front surface 1601. Support arms 1605 and 1607 may position retaining cage 1613 perpendicular to front surface 1601.

Retaining cage defines opening width $l_1$. Retaining cage 1613 includes securing segment 1603. Securing segment 1603 defines support border 1609. A magnitude of width $l_1$ may be sufficiently wide to allow a first length of handle 1503 to be admitted into retaining cage 1613 via opening width $l_1$. The first length of handle 1503 may include a segment of handle 1503 at or near $n_1/n_2$.

An illustrative magnitude of $l_1$ may be between ¾ of an inch and 1 inch. A magnitude of opening width $l_1$ may be sufficiently narrow to prevent a second length of handle 1503 from passing through opening width $l_1$. The second length of handle 1503 may include a segment of handle 1503 between $n_1/n_2$ and $w_1/w_2$.

Retaining cage 1613 defines retaining width $l_2$. An illustrative magnitude of $l_2$ may be between 1 inch and 1¾ of an inch. A magnitude of retaining width $l_2$ may be sufficiently wide to allow the second length of handle 1503 (e.g., between $n_1/n_2$ and $w_1/w_2$) to slide within retaining cage 1613 and relative to support border 1609. A magnitude of retaining width $l_2$ may be sufficiently narrow to prevent a third length of handle 1503 from sliding through retaining cage 1613. The third length may include a segment of handle 1503 at or near $w_1/w_2$ (shown in FIG. 15).

Handle 1503 may be inserted into retaining cage 1613 through $l_1$ at or near $n_1/n_2$. After handle 1503 is positioned within retaining cage 1613, handle 1503 may be slidable within retaining cage 1613. However, handle 1503 at or near $w_1/w_2$ may not fit through $l_1$ and may not be slidable through $l_2$. Thus, after inserting handle 1503 through $l_1$, gravity may cause handle 1503 to slide through retaining cage 1613 until, at or near $w_1/w_2$, handle 1503 will be "caught" and retained within retaining cage 1613 by support border 1609. When handle 1503 is retained by retaining cage 1613, retaining cage 1613 supports sealing dispensing mechanism 1505 affixed to handle 1503.

At or near $w_1/w_2$, handle 1503 may not fit through opening width $l_1$. To remove handle 1503 from retaining cage 1613, a packer may slide handle 1503 upward, against a gravitational force (e.g., toward a head of the packer) until narrow end of handle 1503 (e.g., at or near $n_1/n_2$) is aligned with opening width $l_1$. When the narrow end of handle 1503 is aligned with opening width $\mathbf{1}_1$, handle 1503 may be removed from retaining cage 1613.

Figure 17:
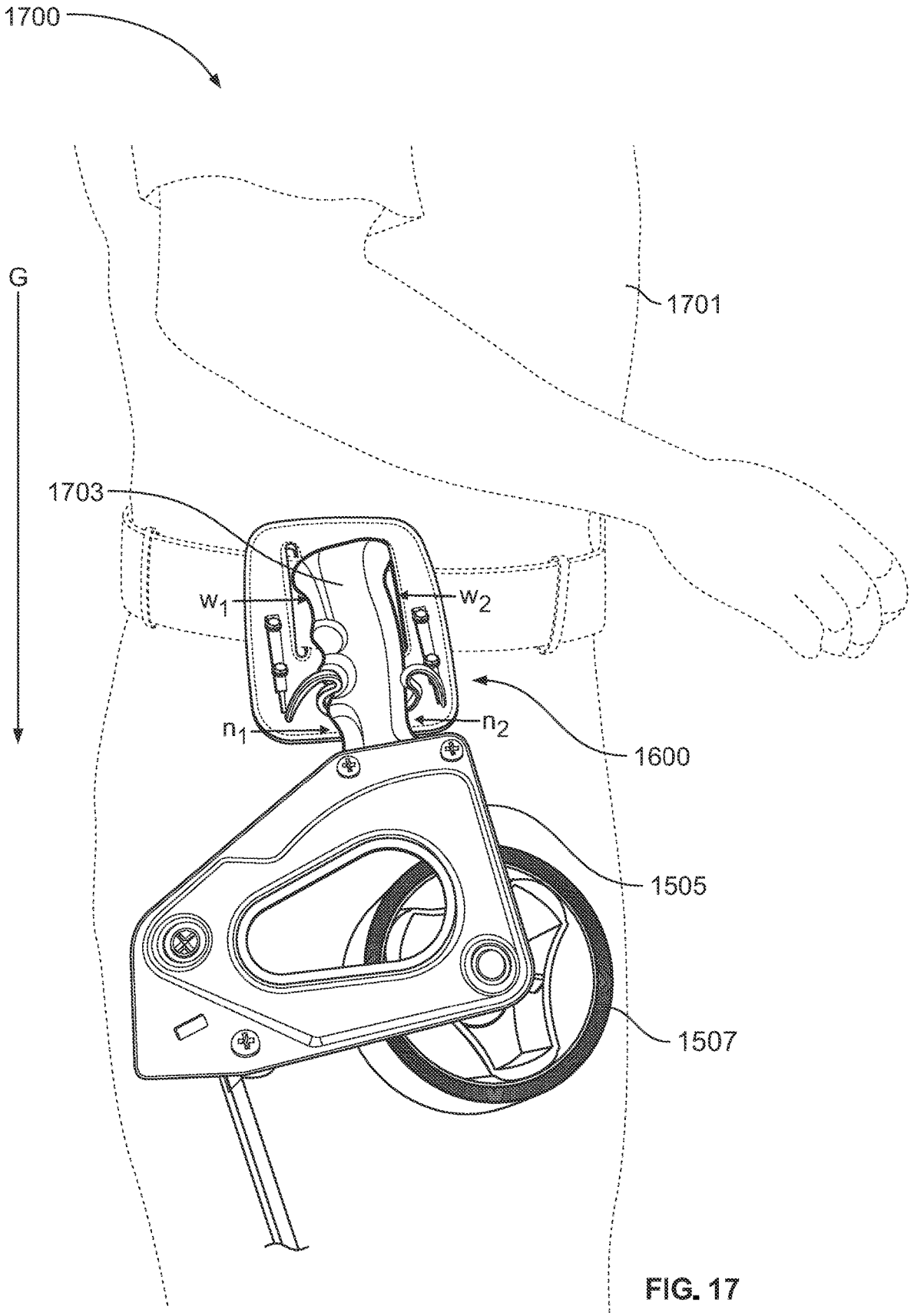
FIG. 17 shows illustrative apparatus and scenario in accordance with principles of the disclosure.

FIG. 17 shows illustrative scenario 1700. Scenario 1700 shows holster 1600 mounted on a belt of packer 1701. Scenario 1700 also shows that portable sealing dispenser 1500 has been inserted into retaining cage 1613. Scenario 1700 shows that portable sealing dispenser 1500 is being supported and retained by retaining cage 1613. Scenario 1700 shows that gravitational force G has pulled dispensing mechanism 1505 downward (toward a floor on which packer 1701 is standing) and thereby caused handle 1703 to slide through retaining cage 1613.

Gravitational force G will pull handle 1703 through retaining cage 1613 until a width of handle 1703 is wider than retaining width $l_2$. When a width of handle 1703 is wider than retaining width $l_2$, handle 1703 cannot slide through retaining width $l_2$ and support border 1609 of retaining cage 1613 will support handle 1503 and dispensing mechanism 1505. Scenario 1700 shows that retaining cage 1613 may define an opening that is greater than a depth of a handle (e.g., depth d of handle 1503, shown in FIG. 15). Scenario 1700 shows that retaining cage 1613 is supporting handle 1703 between $n_1/n_2$ and $w_1/w_2$.

To remove handle 1703 from retaining cage 1613, packer 1701 may slide handle 1703 upwards against gravitational force G (e.g., toward a head of packer 1701) until narrow end $n_1/n_2$ is aligned with opening width $l_1$. When narrow end $n_1/n_2$ is aligned with opening width $l_1$, packer 1701 may remove handle 1503 from retaining cage 1613.

Thus, apparatus and methods for a TAPE DISPENSER HOLSTER SYSTEM have been provided. Persons skilled in the art will appreciate that the present disclosure can be practiced by other than the described embodiments, which are presented for purposes of illustration rather than of limitation.

What is claimed is:

1. A sealing material system comprising;
a retaining cage;
a portable sealing dispenser comprising:
a handle;
a sealing dispensing mechanism; and
a securing flange affixed to the handle;
wherein the retaining cage comprises:
a first width that is configured to receive a first length of the handle; and
a second width that is configured to prevent a second length of the handle from sliding through the retaining cage,
wherein the handle comprises a third length between the first length and the second length and the third length of the handle slides through the retaining cage and does not fit through the first width
an opening segment configured to receive the securing flange; and
a securing segment that is configured to support the securing flange.

2. The system of claim 1, wherein:
the opening segment defines an insertion surface area;
the securing flange defines a flange surface area; and
insertion surface area is larger than the flange surface area.

3. The system of claim 1, wherein:
the securing segment defines a securing surface area;
the securing flange defines a flange surface area; and
securing surface area is smaller than the flange surface area.

4. The system of claim 1, the securing segment defining:

a support border that supports the securing flange against a gravitational force; and at least one retention member that extends perpendicular to the support border and prevents the securing flange from sliding off the support border when the securing flange is seated on the support border.

5. The system of claim 4, wherein the at least one retention member extends from the support border to the opening segment.

6. The system of claim 5, wherein the at least one retention member is configured to guide the securing flange from the opening segment onto the support border.

7. The system of claim 1, wherein the retaining cage is formed from a single contiguous member.

8. The system of claim 1, further comprising a holster, and the retaining cage is affixed to the holster;

wherein:

the holster comprises a front surface and a back surface; and the retaining cage is affixed to the front surface.

9. The system of claim 1, wherein:

the sealing dispensing mechanism is affixed to a first end of the handle; and the securing flange is affixed to a second end of the handle.

10. A sealing material system comprising;

a retaining cage; and a portable sealing dispenser comprising a handle;

wherein the retaining cage comprises:

a first width that is configured to receive a first length of the handle; and a second width that is configured to prevent a second length of the handle from sliding through the retaining cage, wherein the handle comprises a third length between the first length and the second length and the third length of the handle slides through the retaining cage and does not fit through the first width.

11. The sealing material system of claim 10, wherein the second length of the handle has a greater width than the first length of the handle.

12. The sealing material system of claim 10, wherein the retaining cage is configured to prevent the second length of the handle from sliding through the retaining cage and thereby suspend the portable sealing dispenser above a surface.

13. The sealing material system of claim 10, wherein the retaining cage is formed from a single member that is bent to form the first width and the second width.

14. The sealing material system of claim 10, the retaining cage further comprising a support border that is defined by the first width and second width.

15. The sealing material system of claim 10, further comprising a holster, and the retaining cage is mounted on the holster.

16. A method comprising:

using a portable sealing dispenser, applying sealing material dispensed by the portable sealing dispenser to close a first container;

positioning the portable sealing dispenser in a retaining cage mounted on a waistband;

obtaining a second container;

removing the portable sealing dispenser from the retaining cage;

using the portable sealing dispenser, applying sealing material to close the second container; and re-positioning the portable sealing dispenser in the retaining cage wherein the retaining cage comprises:

a first width that is configured to receive a first length of a handle of the portable sealing dispenser; and a second width that is configured to prevent a second length of the handle from sliding through the retaining cage, wherein the handle comprises a third length between the first length and the second length and the third length of the handle slides through the retaining cage and does not fit through the first width.

* * * * *